US010179465B2

(12) United States Patent
Williams et al.

(10) Patent No.: US 10,179,465 B2
(45) Date of Patent: Jan. 15, 2019

(54) CUTTER ACCESSORY FOR PRINTING SYSTEM

(71) Applicant: Avery Dennison Retail Information Services, LLC, Westborough, MA (US)

(72) Inventors: Larri B. Williams, Dayton, OH (US); Lance D. Neuhard, New Carlisle, OH (US); Timothy J. Entingh, Waverly, NY (US); Kelly L. Johnson, Centerville, OH (US)

(73) Assignee: AVERY DENNISON RETAIL INFORMATION SERVICES, LLC, Mentor, OH (US)

( * ) Notice: Subject to any disclaimer, the term of this patent is extended or adjusted under 35 U.S.C. 154(b) by 13 days.

(21) Appl. No.: 15/371,993

(22) Filed: Dec. 7, 2016

(65) Prior Publication Data

US 2017/0157957 A1 Jun. 8, 2017

Related U.S. Application Data

(60) Provisional application No. 62/263,974, filed on Dec. 7, 2015.

(51) Int. Cl.
*B26D 5/16* (2006.01)
*B41J 11/70* (2006.01)
(Continued)

(52) U.S. Cl.
CPC ..... *B41J 11/703* (2013.01); *B26D 1/085* (2013.01); *B26D 5/00* (2013.01); *B26D 5/16* (2013.01);
(Continued)

(58) Field of Classification Search
CPC ..... B41J 11/703; B26D 5/16; B26D 5/00
See application file for complete search history.

(56) References Cited

U.S. PATENT DOCUMENTS 3,099,212 A 7/1963 Sohn
3,749,626 A 7/1973 Buck
(Continued)

FOREIGN PATENT DOCUMENTS

EP 2106887 10/2009
EP 2529938 12/2012

OTHER PUBLICATIONS

International Search Report and Written Opinion of ISA/EPO dated Mar. 13, 2017 prepared for PCT/US2016/065386.

*Primary Examiner* — Sean Michalski
(74) *Attorney, Agent, or Firm* — Avery Dennison Retail Information Services, LLC

(57) ABSTRACT

A cutter accessory is provided for use in combination with a printing device as part of a printing system. The cutter accessory includes a body that is configured to be mounted onto the printing device. An access door is mounted to the body and movable between a closed position and an open position. A slot is defined in the access door and configured to receive printed material from the printing device when the access door is in the closed position. A cutting blade is movably mounted to the body, with at least one cam being associated with the cutting blade. The cam is operable to move the cutting blade with respect to the slot to cut the printed material and is accessible when the access door is in the open position, but not accessible when the access door is in the closed position.

26 Claims, 8 Drawing Sheets

(51) Int. Cl.
*B41J 11/66* (2006.01)
*B26D 1/08* (2006.01)
*B26D 5/00* (2006.01)

(52) U.S. Cl.
CPC ..... *B41J 11/663* (2013.01); *B41J 11/70* (2013.01); *B41J 11/706* (2013.01)

(56) References Cited

U.S. PATENT DOCUMENTS 3,955,502 A 5/1976 Von Hofe
4,035,808 A 7/1977 Karp
4,042,939 A * 8/1977 Lloyd ..... G01D 11/24 156/257
4,111,121 A 9/1978 Borum
4,449,433 A 5/1984 Miyamoto
4,504,162 A 3/1985 Speraggi
4,525,088 A 6/1985 Shipos et al.
4,624,164 A * 11/1986 Passa ..... B23D 15/14 83/542
4,905,558 A 3/1990 Corcoran
4,936,177 A * 6/1990 Ozawa ..... B26D 1/085 83/582
4,979,838 A 12/1990 Yokota et al.
4,981,059 A 1/1991 Kobayashi
5,000,812 A 3/1991 Murphy
5,001,955 A 3/1991 Fujiwara
5,017,257 A 5/1991 Murphy
5,235,887 A * 8/1993 Moriya ..... B26D 1/085 83/140
5,286,317 A 2/1994 Treat et al.
5,388,490 A 2/1995 Buck
5,431,077 A 7/1995 Murakami
5,480,081 A 1/1996 Wilson et al.
5,524,996 A * 6/1996 Carpenter ..... B26D 1/085 101/288
5,584,218 A * 12/1996 Schoendienst ..... B26D 1/0006 83/636
5,613,788 A * 3/1997 Dobring ..... B26D 1/0006 101/93.07
5,690,012 A 11/1997 Blandin et al.
5,784,077 A 7/1998 Silverbrook
5,833,380 A * 11/1998 Hosomi ..... B26D 1/305 400/621
5,881,623 A 3/1999 Otani
5,937,723 A 8/1999 Kirikoshi et al.
6,014,921 A 1/2000 Angel et al.
6,102,596 A 8/2000 Komori et al.
6,109,154 A 8/2000 Miyatsu et al.
6,118,469 A 9/2000 Hosomi
6,152,007 A * 11/2000 Sato ..... B26D 1/0006 83/202
6,155,731 A * 12/2000 Bertalan ..... B41J 11/703 101/227
6,212,984 B1 4/2001 Kane
6,302,605 B1 10/2001 Kanbe
6,339,982 B1 1/2002 Angel et al.
6,491,460 B1 * 12/2002 Sodeyama ..... B41J 3/4075 400/593
6,499,403 B1 12/2002 Laulanet
6,550,908 B1 * 4/2003 Heitz ..... B41J 11/0045 347/104
6,599,044 B2 7/2003 Paris
6,616,360 B2 9/2003 Lehmkuhl
6,641,684 B2 11/2003 Instance
6,664,995 B2 12/2003 Milton et al.
6,742,858 B2 6/2004 Lehmkuhl et al.
6,749,352 B2 6/2004 Yamada
6,782,784 B2 8/2004 Sato et al.
6,786,125 B2 9/2004 Imai
6,832,537 B2 12/2004 Takabatake et al.
7,815,382 B2 10/2010 Monclus et al.
8,047,250 B2 11/2011 Kolp et al.
8,167,017 B2 5/2012 Kolp et al.
8,529,145 B2 9/2013 Cordero et al.
8,562,229 B2 * 10/2013 Inaba ..... B26D 1/0006 400/621
8,596,894 B2 12/2013 Hanaoka
8,613,562 B2 12/2013 Shirotori et al.
8,651,003 B1 * 2/2014 Vercellone ..... B26D 5/16 242/598.6
8,663,410 B2 3/2014 Cummin et al.
8,960,064 B2 2/2015 Supron et al.
9,004,790 B2 4/2015 Kishi et al.
9,167,017 B2 10/2015 Basso et al.
9,199,388 B2 12/2015 Cummins et al.
9,321,286 B2 4/2016 Bar-Tal et al.
9,333,665 B2 5/2016 Niizeki
9,415,612 B2 8/2016 Roctus et al.
9,545,733 B2 1/2017 Maruyama et al.
9,834,007 B2 * 12/2017 Sone ..... B41J 2/32
9,849,601 B2 12/2017 Anayama et al.
9,956,794 B2 5/2018 Mitsuo
2003/0144853 A1 7/2003 Stehouwer et al.
2003/0156883 A1 * 8/2003 Kobayashi ..... B26D 3/085 400/621
2004/0028505 A1 * 2/2004 Bilbrey ..... B42C 9/0068 412/8
2005/0000842 A1 1/2005 Timmerman et al.
2005/0123336 A1 6/2005 Oshida et al.
2006/0162524 A1 7/2006 Suzuki et al.
2007/0095179 A1 5/2007 McCarty et al.
2008/0060535 A1 3/2008 Edwards et al.
2008/0223512 A1 9/2008 Sievel
2008/0236354 A1 10/2008 Esposito
2011/0155324 A1 6/2011 Tai
2011/0170931 A1 * 7/2011 Kawaguchi ..... B26D 1/085 400/621
2011/0280644 A1 11/2011 Toyoshima
2011/0290093 A1 12/2011 Kikuchi
2014/0210896 A1 7/2014 Bar-Tal et al.
2015/0053104 A1 2/2015 Schuh et al.
2016/0067987 A1 3/2016 Ohashi et al.
2016/0303892 A1 * 10/2016 Killian ..... B44B 3/009
2017/0087889 A1 3/2017 Kikuchi et al.
2017/0087890 A1 3/2017 Masuda et al.
2017/0200073 A9 7/2017 Duckett et al.

* cited by examiner

CUTTER ACCESSORY FOR PRINTING SYSTEM

CROSS REFERENCE TO RELATED APPLICATIONS

This application claims priority to and the benefit of U.S. provisional patent application No. 62/263,974 filed on Dec. 7, 2015, which is incorporated by reference herein in its entirety.

FIELD OF THE DISCLOSURE

The present subject matter relates to printing systems. More particularly, the present subject matter relates to cutter accessories that may be removably mounted to a printing device.

DESCRIPTION OF RELATED ART

Printing devices, such as thermal printers, are used to generate printed material. If the substrate of the printed material is provided on a roll or otherwise not provided in discrete units or pieces (e.g., individual sheets or labels), then the printed material must be cut to size. Typically, the printing device includes a built-in cutter, which cuts the substrate to size after print has been applied to the substrate. While built-in cutters may provide adequate functionality, they may also result in various disadvantages when maintenance is required. For example, if the substrate becomes caught or jammed in the cutter while passing through the printing device or if the cutter otherwise becomes inoperative, then the cutter must be accessed to correct the error. Traditional printing devices require several guard plates to be removed to access the built-in cutter, which increases the time that the printing device is inoperative. Accordingly, it would be advantageous to provide a printing system with a cutter that may be more easily serviced.

SUMMARY

There are several aspects of the present subject matter, which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as may be set forth in the claims appended hereto.

In one aspect, a cutter accessory is provided for use in combination with a printing device. The cutter accessory includes a body that is configured to be mounted onto the printing device. An access door is mounted to the body and movable between a closed position and an open position. A slot is defined in the access door and configured to receive printed material from the printing device when the access door is in the closed position. A cutting blade is movably mounted to the body, with at least one cam being associated with the cutting blade. The cam is operable to move the cutting blade with respect to the slot to cut the printed material and is accessible when the access door is in the open position, but not accessible when the access door is in the closed position.

In another aspect, there is provided a printing system, which includes a printing device and a cutter accessory. The printing device includes a housing and an opening, which is defined in the housing and configured to issue printed material. The cutter accessory includes a body that is mounted to the housing of the printing device. An access door is mounted to the body and movable between a closed position and an open position. A slot is defined in the access door and at least partially aligned with the opening of the printing device to receive printed material issuing from the opening of the printing device when the access door is in the closed position. A cutting blade is movably mounted to the body, with at least one cam being associated with the cutting blade. The at least one cam is operable to move the cutting blade with respect to the slot to cut the printed material issuing from the printing device and is accessible when the access door is in the open position, but not accessible when the access door is in the closed position.

DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
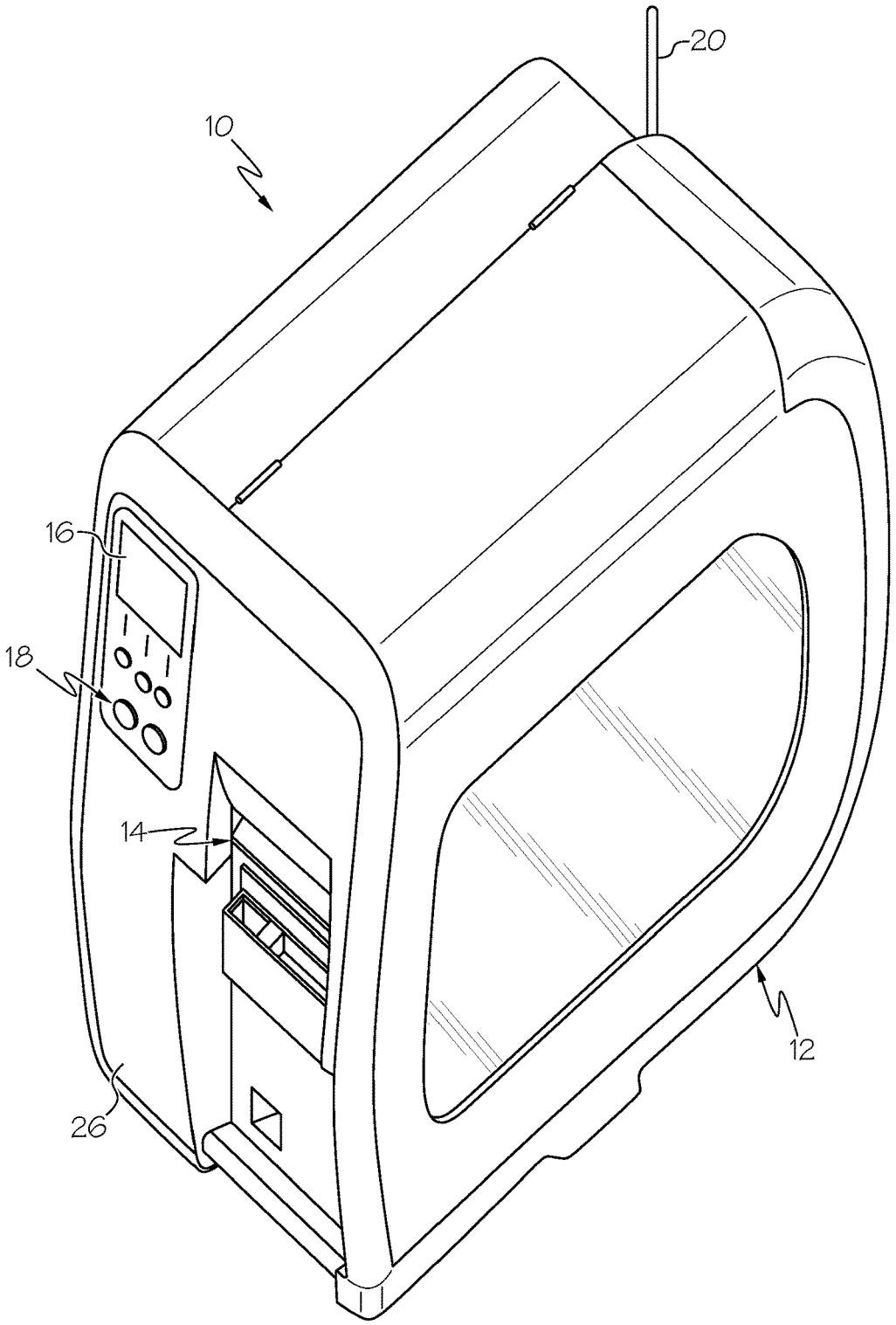
FIG. 1 is a front perspective view of a printing device.

Printing Device. To address the disadvantages of known systems, it has been found to be convenient to provide a cutter accessory that may be removably mounted to a printing device not having a built-in cutter. FIG. 1 shows such a printing device 10 configured as a thermal printer, but it is also within the scope of the present disclosure for the printing device 10 to incorporate other printing technology (e.g., laser or inkjet). It should also be understood that the illustrated printing device 10 is merely exemplary and that the configuration may vary without departing from the scope of the present disclosure.

The illustrated printing device 10 includes an enclosure or housing 12, which may be formed of any suitable material or materials (e.g., a generally rigid metal material and/or generally rigid plastic material). The housing 12 contains various components, which may include a supply of substrate material, a mechanism for applying print to the substrate material, and a mechanism for moving the substrate material through the interior of the housing 12 and out of the housing 12 via an opening 14, where it exits the printing device 10 as printed material. The printing device 10 may also include a controller (e.g., a microprocessor) that controls the operation of the other components of the printing device 10. The printing device 10 may include assorted other components and functionality (e.g., a display screen 16 and user interface 18 and an antenna 20 for wireless communication) without departing from the scope of the present disclosure.

Figure 2:
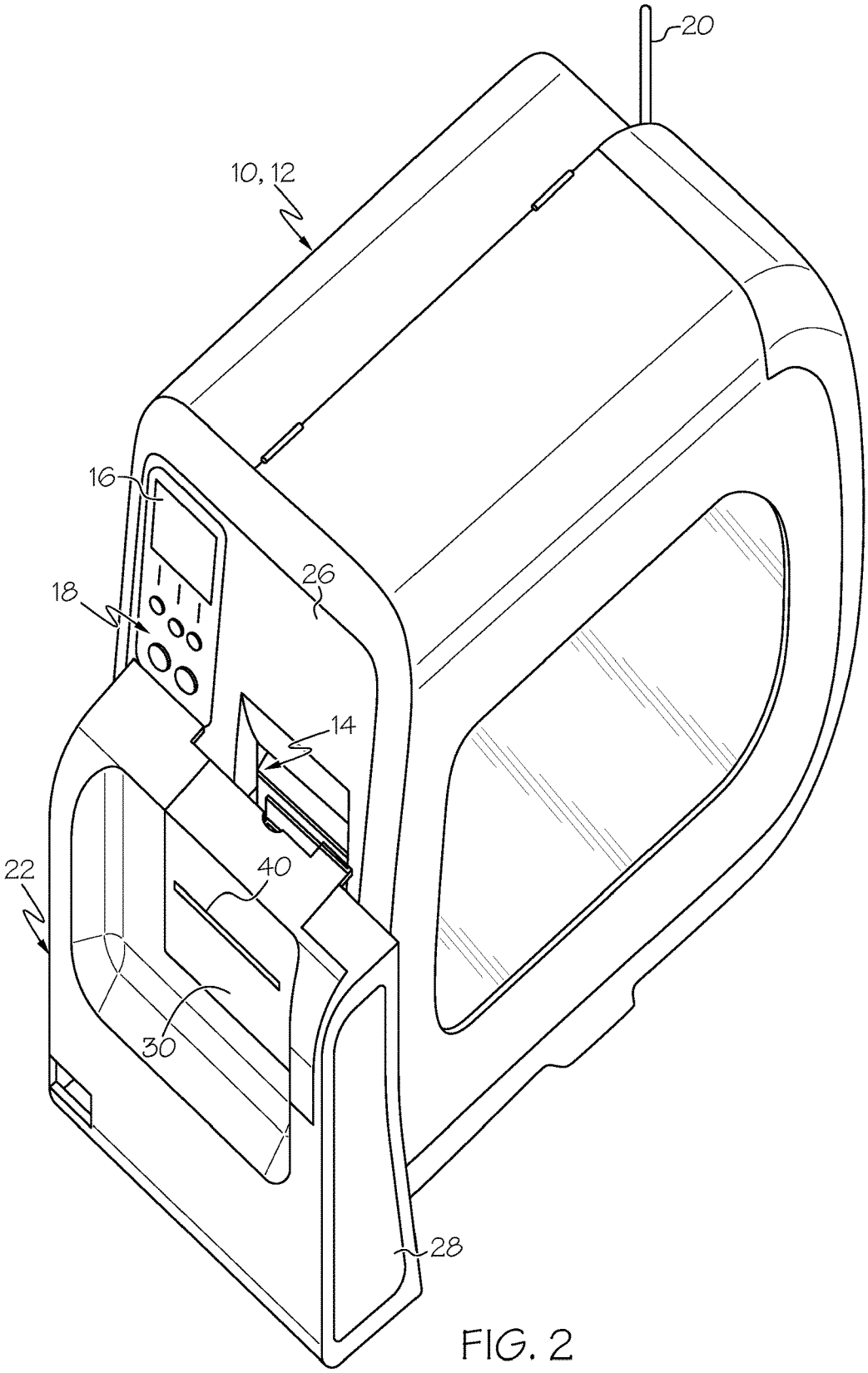
FIG. 2 is a front perspective view of a printing system incorporating the printing device of FIG. 1.

Cutter Accessory. The printing device 10 may be combined with a cutter accessory 22 (FIGS. 2 and 3) to provide a printing system 24 (FIG. 2). The cutter accessory 22 is configured to receive printed material from the printing device 10 for cutting the printed material to size, so the way in which the cutter accessory 22 is mounted to the printing device 10 depends at least in part upon the position of the opening 14 from which printed material exits the printing device 10. In the illustrated embodiment, the opening 14 is defined in a front face or front panel 26 of the printing device 10 (FIG. 1), such that the cutter accessory 22 may be mounted to the front panel 26 of the printing device 10 to receive the printed material. In other embodiments, in which printed material may issue from the printing device at a different location, the associated cutter accessory may be differently configured for a different mounting arrangement. It may be advantageous for the cutter accessory 22 to be removably mounted to the printing device 10 (e.g., being fastened to the printing device 10 by screws or the like), although it is also within the scope of the present disclosure for the cutter accessory 22 to be fixedly secured to the printing device 10 (e.g., by a welding operation).

The cutter accessory 22 has a body or base 28 that may be contoured or configured to match the portion of the printing device housing 12 adjacent to the opening 14. For example, in the illustrated embodiment, in which printed material issues from an opening 14 defined in the front panel 26 of the printing device 10, the configuration and shape of the body 28 of the cutter accessory 22 may be informed by the configuration of the portion of the front panel 26 of the printing device 10 in the vicinity of the opening 14. The body 28 of the cutter accessory 22 may be formed of any suitable material or materials, such as a generally rigid metal material and/or a generally rigid plastic material.

An access door or cover 30 is mounted to the body 28 and movable between a closed position (FIG. 3) and an open position (FIG. 4), as will be described in greater detail. The illustrated access door 30 is hingedly connected to the body 28 of the cutter accessory 22, which allows the access door 30 to move between its closed and open positions by pivotal movement, but it is also within the scope of the present disclosure for the access door 30 to move between its closed and open positions in a different manner (e.g., by sliding or translational movement). It is also within the scope of the present disclosure for the access door 30 to be detached to move it from the closed position to the open position.

The functionality of the cutter accessory 22 preferably depends upon the position of the access door 30. As will be described in greater detail, the cutter accessory 22 may be in an operative or functional state when the access door 30 is in its closed position (FIG. 3) and in an inoperative or partial-functionality state when the access door 30 is in its open position (FIG. 4). To that end, the cutter accessory 22 may be provided with a controller (e.g., a microprocessor) that is programmed with an active state (for when the access door 30 is in its closed position) and an inactive state (for when the access door 30 is in its open position). Alternately, when the door is in the open state the driver could disengage the knife motor preventing accidental firing of the knife while it is being serviced. FIG. 5 shows an exemplary electrical circuit 32 by which the controller 34 of the cutter accessory 22 may be electrically coupled to a door sensor or interlock open switch 36, which monitors the position of the access door 30, thereby allowing the controller 34 to determine which state it should be in. The electrical circuit 32 will be described in greater detail herein.

Figure 6:
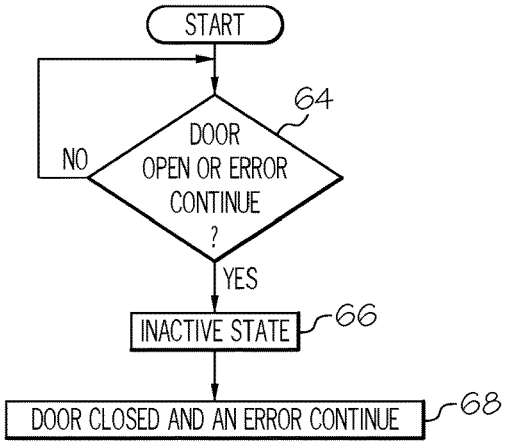
FIG. 6 is a diagrammatic view of a protocol executed by the controller of the cutter accessory when the access door is in the open position or in the event of an error condition.
Figure 7:
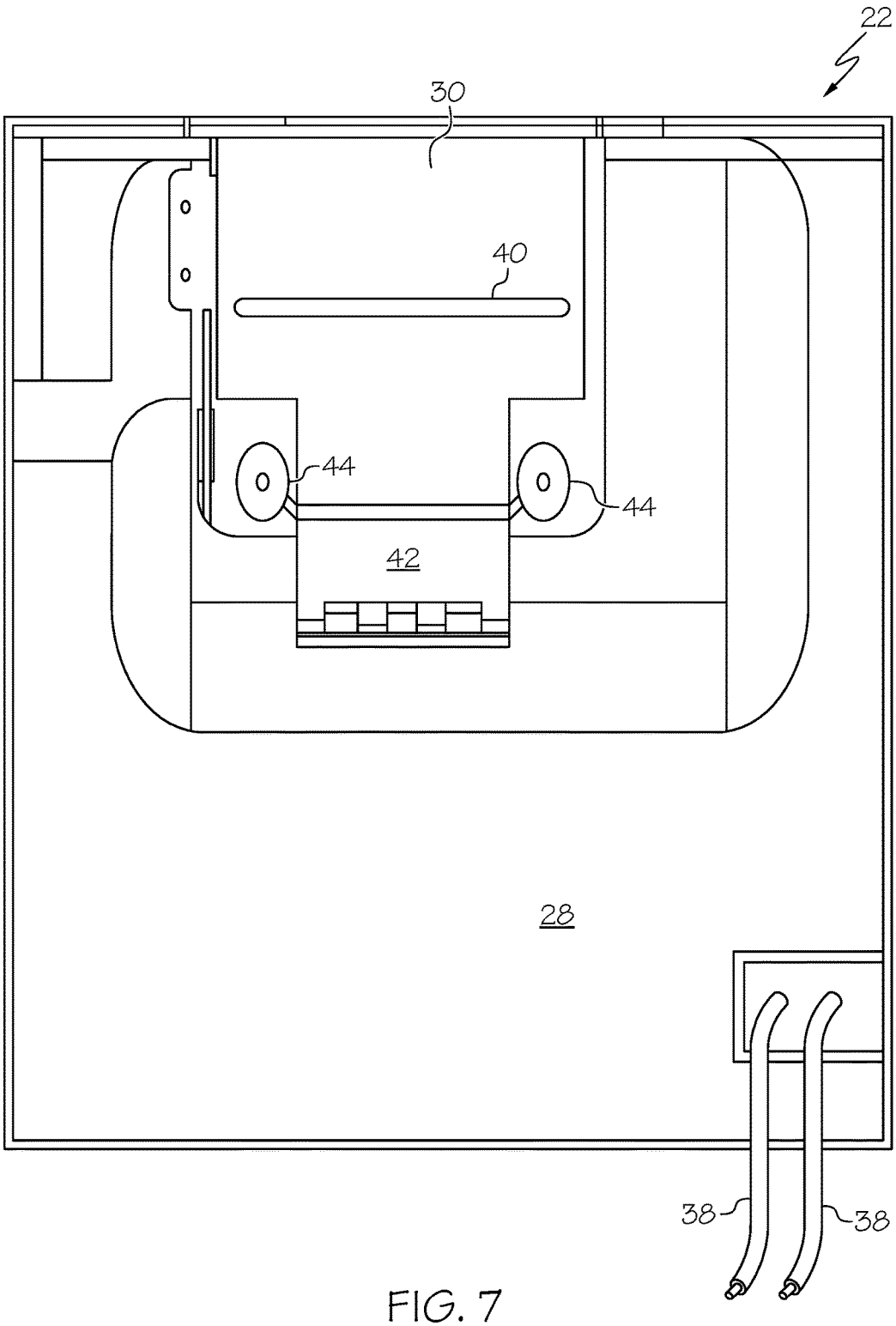
FIG. 7 is a rear perspective view of the cutter accessory of FIG. 3.

FIG. 6 illustrates a protocol that may be executed by the controller 34 when the access door 30 is in its open position or during an error condition, which will be described in greater detail. As a part of this protocol, the controller 34 may transmit a signal to the printing device 10 (e.g., to instruct the printing device 10 to move to an inoperative or partial-functionality state and/or to display an image on the display screen 16). The cutter accessory 22 may be provided with one or more cables 38 (FIG. 7) to electrically couple the cutter accessory 22 to the printing device 10, which may provide the cutter accessory 22 with power and/or allow the cutter accessory 22 and the printing device 10 to communicate with each other. In an alternative embodiment, the cutter accessory 22 may be electrically uncoupled from the printing device 10, in which case the cutter accessory 22 may include an independent power source and may communicate wirelessly with the printing device 10 (either directly or through a separate system controller).

Turning back now to the configuration of the access door 30, a slot 40 may be defined therein, with the slot 40 being configured and oriented to receive the printed material that issues from the opening 14 of the printed device 10. Accordingly, the slot 40 may be at least partially aligned with the opening 14 of the printed device 10 when the cutter accessory 22 is mounted to the printing device 10, with the access door 30 in the closed position, as in FIG. 2.

A cutting blade 42 (FIG. 7) is movably mounted to the body 28 of the cutter accessory 22. At least one cam 44 (illustrated in FIGS. 4 and 7 as two cams) is associated with the cutting blade 42 and operable to move the cutting blade 42 with respect to the slot 40. When the access door 30 is in its closed position (FIG. 3), the cams 44 may be rotated under control of the controller 34 to move the cutting blade 42 in a reciprocating up-and-down motion (in the orientation of FIG. 7) to cut printed material positioned within the slot 40. In other embodiments, the cutting blade 42 and/or cams 44 may be differently configured, positioned, and/or oriented and/or move in a different manner to cut the printed material to size.

The controller 34 only instructs the cams 44 to move the cutting blade 42 when the access door 30 is in its closed position. When the access door 30 is in its open position, the controller 34 is in its inactive state and does not instruct the cams 44 to move the cutting blade 42. While the controller 34 does not operate the cams 44 when it is in its inactive state, the cams 44 may be manually operated to service the cutter accessory 22. For improved maintenance, the cams 44 may be configured and oriented such that they may be accessed when the access door 30 is in its open condition (FIG. 4). Preferably, the cams 44 are covered or otherwise inaccessible when the access door 30 is in its closed condition (FIG. 3) to prevent the cams 44 from being manually manipulated during normal operation of the printing system 24. By such a configuration, an operator or service technician can service the cams 44 by simply opening the access door 30 (thereby placing the controller 34 into an inactive state), rather than requiring several guard plates to be removed (as in typically required with built-in cutters).

In the illustrated embodiment, each cam 44 includes an exposed surface or portion 46 (FIG. 4) that faces away from the printing device 10 when the cutter accessory 22 is mounted to the printing device 10. Each exposed surface 46 is configured to accommodate a tool (e.g., by defining a socket that can receive the end of a hex key or Allen key) that may be used to manually rotate the associated cam 44 when the access door 30 is in its open position. Alternatively, rather than being configured to accommodate a tool, each exposed surface 46 may be configured to allow for the associated cam 44 to be rotated using one or more digits (e.g., by pressing a finger against the exposed surface 46 and moving the finger in a way that rotates the cam 44 or gripping an extension or formation of the exposed surface 46).

Rotating the cam 44 causes the cutting blade 42 to also move, which may be necessary to free printed material that has become jammed or caught on the cutting blade 42. After at least one of the cams 44 has been manually manipulated or other corrective action has been taken (e.g., reorienting printed material passing from the printing device 10 through the cutter accessory 22), the access door 30 may be closed, which causes the controller 34 to determine whether the cutter accessory 34 is in condition for normal operation (FIG. 6).

Figure 3:
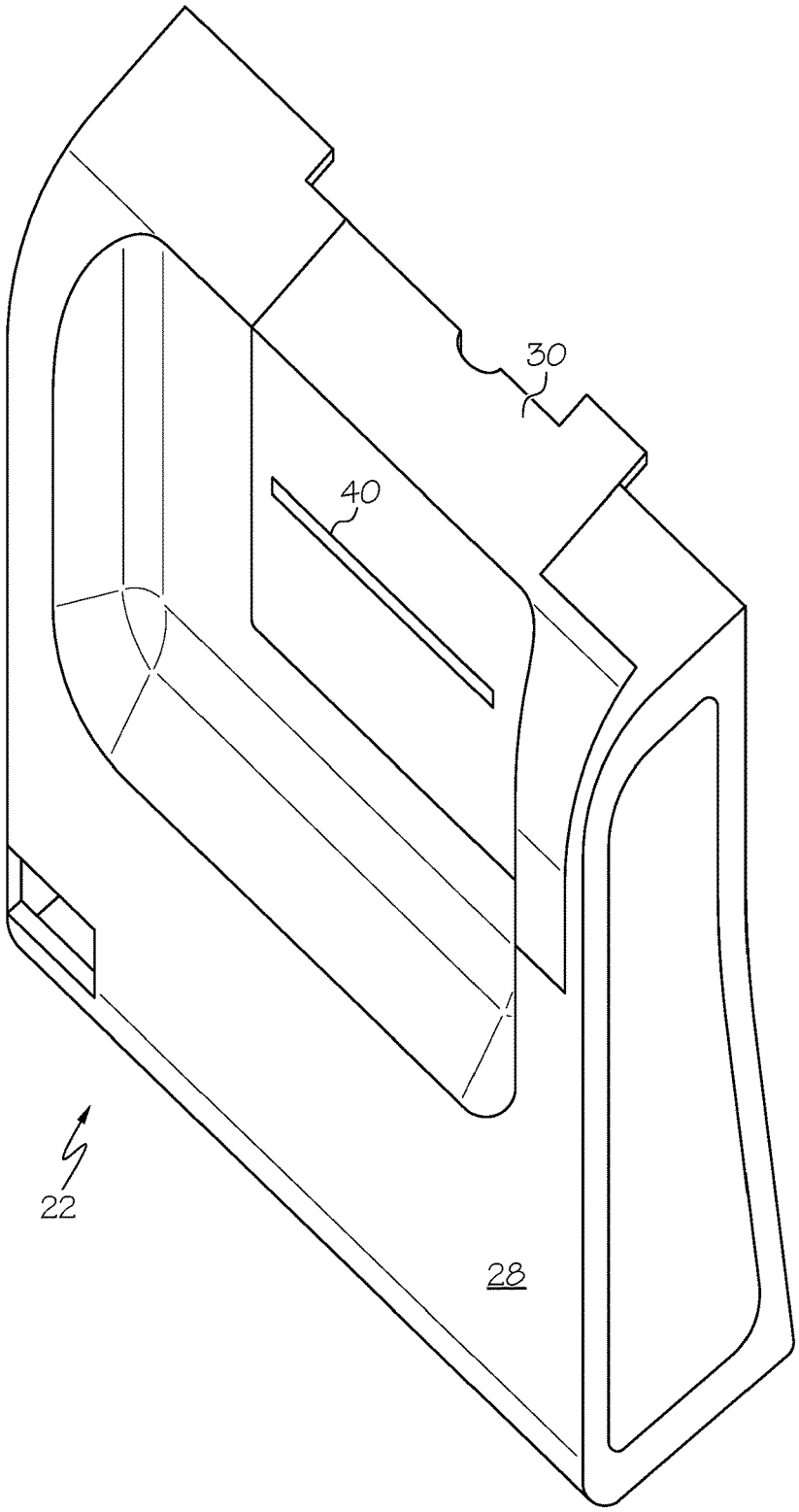
FIG. 3 is a front perspective view of a cutter accessory of the printing system of FIG. 2, with an access door of the cutter accessory being in a closed position.
Figure 4:
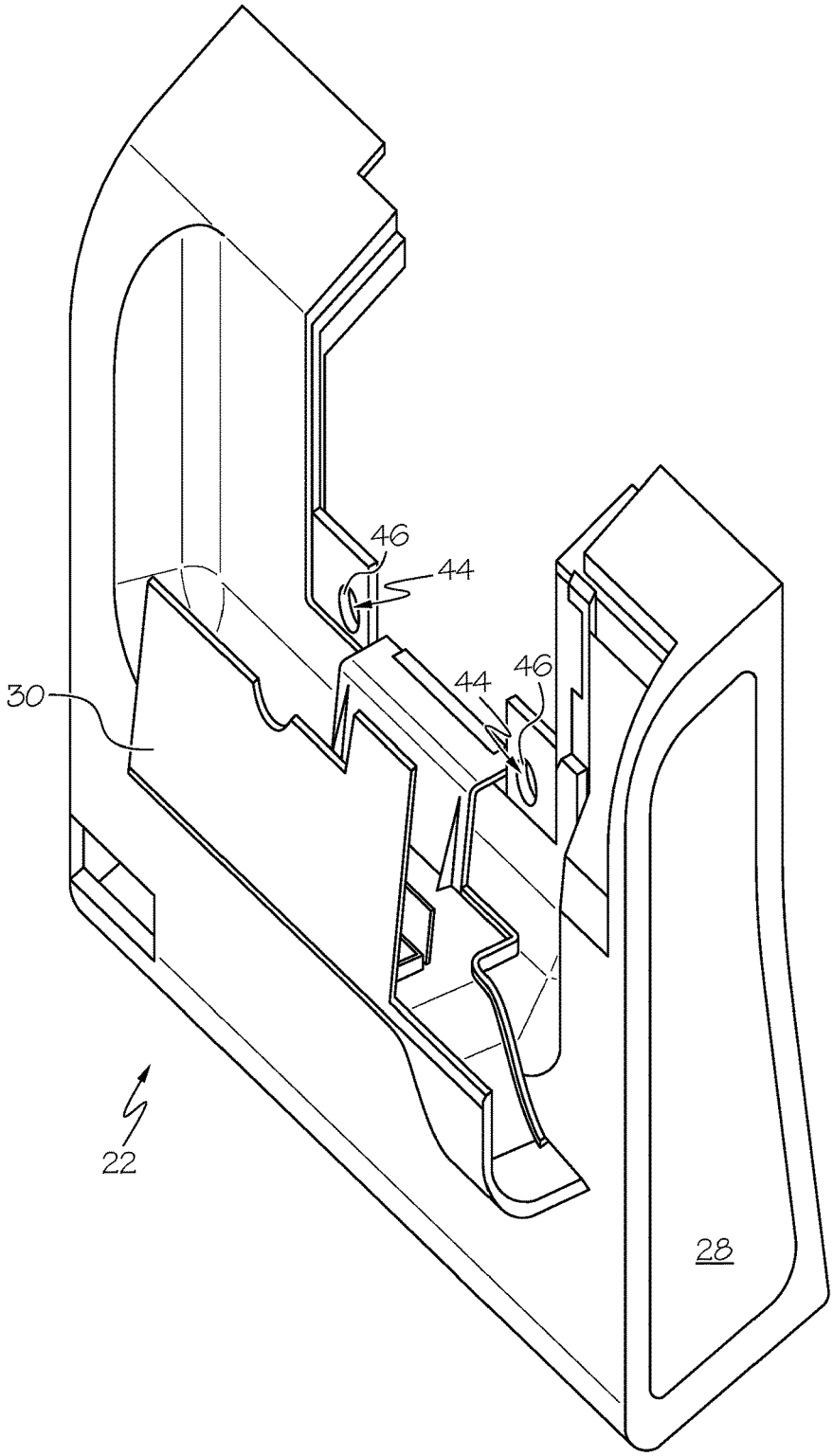
FIG. 4 is a front perspective view of the cutter accessory of FIG. 3, with the access door in an open position.
Figure 5:
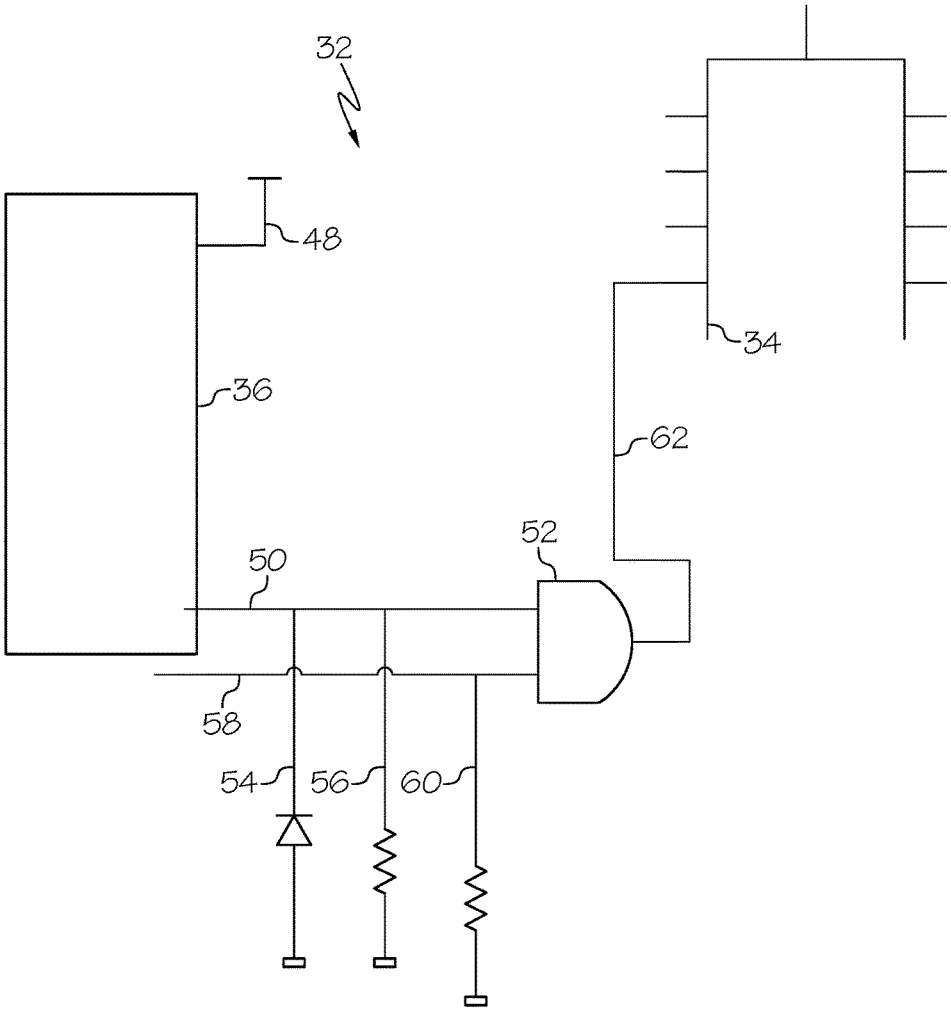
FIG. 5 is a diagrammatic view of an electrical circuit that electrically couples a controller of the cutter accessory to a door sensor.

It should be understood that the cutter accessory 22 of FIGS. 3 and 4 is merely exemplary and that a cutter accessory according to the present disclosure may be differently configured without departing from the scope of the present disclosure. For example, it is contemplated that the cutter accessory may be differently configured, include additional components (e.g., a display screen), and/or have additional functionality.

Normal Operation. When the cutter accessory 22 is fully connected to the printing device 10, with the access door 30 in its closed position (FIG. 2), the printing system 24 is ready for normal operation. During normal operation, a user instructs the printing device 10 (e.g., using the user interface 18) or the printing device 10 otherwise receives a command (e.g., via the antenna 20) to apply print to the substrate material. The substrate material is moved through the interior of the printing device 10, with print being applied to a portion of it. At least the printed portion of the substrate material exits the printing device 10 via the opening 14 and passes into the slot 40 of the cutter accessory 22.

The cam or cams 44 of the cutter accessory 22 are operated under command of the controller 34 to move the cutting blade 42 to cut the substrate material to size as it passes through the slot 40, resulting in a properly sized unit or piece of printed material. The controllers of the cutter accessory 22 and the printing device 10 may communicate with each other to coordinate the actions of the printing device 10 and the cutter accessory 22. Alternatively, rather than the printing device 10 and the cutter accessory 22 communicating with each other, they may each communicate with a separate system controller that monitors and coordinates the actions of the printing device 10 and the cutter accessory 22.

Error/Open Door Condit ion. In the event of an error (e.g., if the substrate material becomes stuck within the printing device 10), normal operation of the printing system 24 may be temporarily interrupted. An error condition may be diagnosed by the any of the controllers associated with the printing system 24 according to any suitable approach (e.g., by electrically coupling a sensor that monitors the expected movement of the cams 44 and/or the cutting blade 42 to the controller 34 of the cutter accessory 22). If the printing system 24 includes more than one controller, then the controller that diagnoses an error condition may alert the other controller(s) to move all of the necessary components to an inoperative or partial-functionality state (e.g., to prevent additional substrate material from issuing from the printing device 10 if the cutting blade 42 is jammed).

If the printing device 10 and/or the cutter accessory 22 has a display screen (as in the illustrated embodiment, in which the printing device 10 includes a display screen 16), at least one image may be displayed to indicate an error condition. The image may be a letter or letters, a symbol or icon or pictogram, a change in color and/or brightness, or any combination thereof and may be accompanied by an audible alert to draw the attention of a user or service technician to the display screen. The image may indicate the occurrence of an error, identify the nature and/or location of the error, and/or offer suggested corrective actions to take to address the error.

Access Door Monitoring. If the cutter accessory 22 stops operating normally due to the cutting blade 42 becoming jammed, the display screen 16 may instruct a user to open the access door 30 of the cutter accessory 22. As a safety feature, the cutter accessory 22 may be provided with an interlock that prevents the controller 34 from causing the cams 44 to move while the access door 30 is in its open position by placing the controller 34 in an inactive state. As described above and as shown in FIG. 5, this interlock may include a door sensor or interlock open switch 36 that is associated with the access door 30. FIG. 5 shows an exemplary circuit 32 that may be used to electrically couple the door sensor 36 to the controller 34, in which the door sensor 36 is driven with input voltage 48 and transmits an output or signal 50, which represents the position of the access door 30. In one embodiment, the output 50 has a low voltage state (equivalent to a digital or binary 0) when the access door 30 is in its closed position and a high voltage state (equivalent to a digital or binary 1) when the access door 30 is in its open position. In other embodiments, the nature of the output 50 from the door sensor 36 may be reversed, with its low voltage state representing the access door 30 being in its open position and its high voltage state representing the access door 30 being in its closed position, as will be described in greater detail.

In the circuit 32 of FIG. 5, the output 50 from the door sensor 36 is an input to an AND gate 52, with a diode 54 and a resistor 56 being electrically coupled to the output 50. If provided, the diode 54 may prevent excessive positive or negative voltages, while the resistor 56 may prevent unnecessary ringing or echoes on the conductor between the door sensor 36 and the AND gate 52.

The AND gate 52 receives a second input 58, which may be provided with an associated resistor 60 to prevent static voltages from impacting the result value. The second input 58 may be a ground input to the AND gate, with the second input 58 being at a high voltage state (equivalent to a digital or binary 1). In other embodiments, the second input 58 may represent some other source and/or provide some other function, as will be described in greater detail.

The AND gate 52 may be configured and function according to conventional design, by only outputting an output or signal 62 with a high voltage state (equivalent to a digital or binary 1) when both of its inputs 50 and 58 are at a high voltage state (i.e., when the AND gate 52 receives two inputs 50 and 58 that are equivalent to a digital or binary 1). Thus, in the illustrated embodiment, the output 62 from the AND gate 52 may only be at a high voltage state when the access door 30 is in its open position.

The output 62 from the AND gate 52 is fed into the controller 34, which may use the output 62 as the basis for (or at least a factor in) determining whether to operate in its active state or its inactive state. The controller 34 may be programmed such that, when the output 62 of the AND gate 52 is at a low voltage state (i.e., when the access door 30 is in its closed position), the controller 34 is in its active state, in which the controller 34 may drive the cams 44 to move the cutting blade 42. The controller 34 may be further programmed such that, when the output 62 of the AND gate 52 is at a high voltage state (i.e., when the access door 30 is in its open position), the controller 34 is in an inactive state, in which the controller 34 may not drive the cams 44 to move the cutting blade 42. Thus, by such a configuration, the cutting blade 42 is only moved under command of the controller 34 when the access door 30 is closed, which prevents the cutting blade 42 from being driven during maintenance.

It may be advantageous for the controller 34 to also monitor whether the printing system 24 is experiencing an error condition. In one embodiment, a circuit that is comparable to the circuit 32 of FIG. 5 may be used to electrically couple the controller 34 with one or more sensors that monitor the operation of one or more components of the printing system 24 (e.g., the cams 44). If one of these sensors transmits a signal to the controller 34 that is indicative of an error condition (e.g., the cams 44 not rotating when instructed by the controller 34), then the controller 34 may transition to its inactive state, similar to the way in which the controller 34 transitions to its inactive state when the access door 30 is opened. Thus, by such a configuration, the controller 34 only allows normal operation of the cutter accessory 22 when the access door 30 is closed and the various components of the printing system 24 are functioning properly.

In another embodiment, the door and error monitoring functions may be incorporated into a single circuit of the type shown in FIG. 5. In such an embodiment, the output 50 of the door sensor 36 is reversed compared to the previously described embodiment, such that the output 50 has a high voltage state (equivalent to a digital or binary 1) when the access door 30 is in its closed position and a low voltage state (equivalent to a digital or binary 0) when the access door 30 is in its open position.

In this embodiment, rather than being a ground input, the second input 58 of the AND gate 52 comes from one or more sensors that monitor the operation of one or more components of the printing system 24. The second input 58 may be at a high voltage state (equivalent to a digital or binary 1) when the monitored component(s) of the printing system 24 are operating properly and at a low voltage state (equivalent to a digital or binary 0) when the component(s) of the printing system 24 are not operating properly (e.g., in the event that the cams 44 and/or cutting blade 42 becomes jammed). It is also within the scope of the present disclosure for the second input 58 to be associated only with sensors that monitor the operation of the cutter accessory 22, with the controller 34 receiving a separate input that is indicative of normal operation or an error condition of the printing device 10.

The AND gate 52 may be configured and function according to conventional design, such that the output 62 from the AND gate 52 may only be at a high voltage state when both of its inputs 50 and 58 are at a high voltage state (i.e., when the access door 30 is in its closed position and the components of the printing system 24 are operating properly). As describe previously, the output 62 from the AND gate 52 is fed into the controller 34, which may use the output 62 as the basis for (or at least a factor in) determining whether to operate in its active state or its inactive state. In this embodiment, the controller 34 may be programmed such that, when the output 62 of the AND gate 52 is at a high voltage state (i.e., when the access door 30 is in its closed position and the components of the printing system 24 are operating properly), the controller 34 is in its active state, in which the controller 34 may drive the cams 44 to move the cutting blade 42. The controller 34 may be further programmed such that, when the output 62 of the AND gate 52 is at a low voltage state (i.e., when the access door 30 is in its open position and/or the components of the printing system 24 are not operating properly), the controller 34 is in an inactive state, in which the controller 34 may not drive the cams 44 to move the cutting blade 42. Thus, by such a configuration, the cutting blade 42 is only moved under command of the controller 34 when the access door 30 is closed and the printing system 24 is operating properly, which prevents the cutting blade 42 from being driven during maintenance and during an error condition (which could damage the cutter accessory 22).

Cutter Accessory During Error/Open Door Condition. When the access door 30 is open and/or the cutter accessory 22 is in an error condition, the controller 34 of the cutter accessory 22 may execute a protocol of the type shown in FIG. 6. In the exemplary protocol of FIG. 6, the controller 34 monitors or is informed of the access door 30 being open or the existence of an error condition, which is represented at 64. This stage may correspond to the functionality represented in FIG. 5, in which the controller 34 enters an inactive state when the access door 30 is open and/or there is an error condition. It may be advantageous to provide the controller 34 with additional functionality, such as the ability to distinguish between the reason for its inactive state (i.e., determining whether the access door 30 is open and there is no error condition, there is an error condition and the access door 30 is closed, or the access door 30 is open and there is an error condition), which would allow the controller 34 to transmit a variety of different signals to the printing device 10.

When the controller 34 determines that the access door 30 is open and/or there is an error condition (represented in FIG. 6 as a "YES" decision), the controller 34 moves from its active state into its inactive state (as described previously), which is represented in FIG. 6 at 66. Upon transitioning to its inactive state, the controller 34 halts operation of the cams 44 and transmits a signal to instruct the printing device 10 (either directly or via a separate system controller) to move from an operative or functional state to an inoperative or partial-functionality state. The signal may include additional information about the nature of the interruption of normal operation. For example, the signal may be an "open door signal" (indicating that the access door 30 is open and there is no error condition), an "error signal" (indicating that there is an error condition and the access door 30 is closed), or a "combined interruption" signal (indicating that the access door 30 is open and there is an error condition).

When the error condition (if any) has been addressed and the access door 30 is moved to its closed position (represented in FIG. 6 at 68), the cutter accessory 22 may transition from its inactive state to its active state (as described previously), thereby transmitting a "ready signal" to the printing device 10 (either directly or through a separate system controller) that it may return to its operative or functional state. This causes the protocol of FIG. 6 to repeat, with the controller 34 of the cutter accessory 22 monitoring whether the access door 30 is open and/or there is an error condition.

Figure 8:
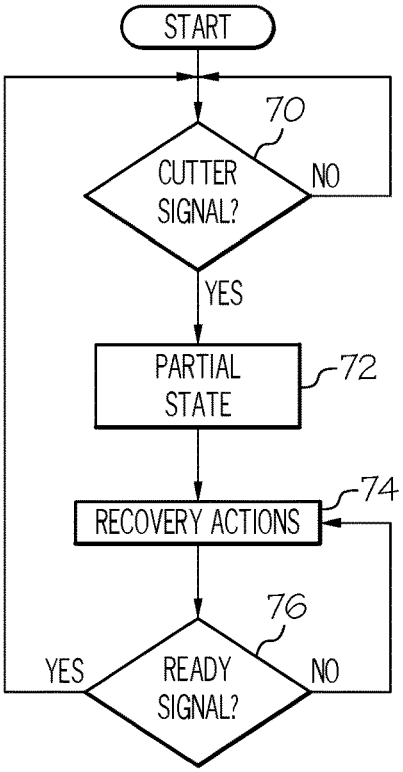
FIG. 8 is a diagrammatic view of a protocol executed by a controller of the printing device when the access door of the cutter accessory is open or in the event of an error condition.

Printing Device During Error/Open Door Condition. FIG. 8 showing an exemplary protocol that may be executed by a controller of the printing device 10 during an error or open door condition, at least partially concurrent with the FIG. 6 protocol carried out by the controller 34 of the cutter accessory 22.

At stage 70 of FIG. 8, the controller of the printing device 10 checks for a signal from the cutter accessory 22 or a separate system controller that signifies an error or open door condition. Upon receiving such a signal (represented in FIG. 8 as a "YES" decision), the printing device 10 moves from an operative or functional state to an inoperative or partial-functionality state. In transitioning from the operative or functional state to the inoperative or partial-functionality state (represented in FIG. 8 at 72), operation of the various components of the printing device 10 may be paused or halted to prevent the creation of additional printed material. At this time, the signal received from the controller 34 of the cutter accessory 22 may also cause at least one image to be displayed on the display screen 16 of the printing device 10 (if provided), as described previously, which may vary depending on the nature of the signal. For example, an "error signal" (described previously) may result in the display screen 16 identifying the error and instructing a user or service technician to open the access door 30 to correct the error. An "open door" signal (described previously) may result in the display screen 16 instructing a user or service technician to close the access door 30 to resume normal operation of the printing system 24. A "combined interruption" signal (described previously) may result in the display screen 16 providing a user or service technician with instructions for correcting the error and instructing them to close the access door 30 upon carrying out the recommended process.

While in its inoperative or partial-functionality state, the printing device 10 may perform any necessary actions as part of the recovery process, such as providing additional messages to a user or service technician via the display screen 16 (represented in FIG. 8 at 74). During this time, the controller of the printing device 10 also checks for the "ready signal" from the cutter accessory 22 or a separate system controller, which indicates that the error condition (if any) has been addressed and the access door 30 has been moved to its closed position (represented in FIG. 8 at 76). If the signal received by the controller of the printing device 10 indicates that the access door 30 is still open and/or there remains an error condition (represented in FIG. 8 by a "NO" decision), the printing device 10 returns to stage 74 and performs any necessary actions as part of the recovery process. Otherwise, if the signal received by the controller of the printing device 10 is the "ready signal" and indicates that the access door 30 has been closed and that the error condition has been successfully resolved (i.e., upon the controller 34 of the cutter accessory 22 moving to its active state), then the printing device 10 may transition from its inoperative or partial-functionality state to its operative or functional state. This causes the protocol of FIG. 8 to repeat, with the controller of the printing device 10 waiting to receive a signal indicating an error or open door condition.

In another embodiment, in addition to the controller 34 of the cutter accessory 22 being capable of instructing the printing device 10 to pause its operation (as in the protocol of FIG. 8), the controller of the printing device 10 may be capable of instructing the cutter accessory 22 to pause its operation in the event of an error in the operation of the printing device 10 (if the cutter accessory 22 does not itself detect such an error due to a disruption in the expected flow of the substrate material out of the printing device 10). Accordingly, either controller may take the lead in resolving an error condition, depending on whether the error arises in operation of a component of the printing device 10 or the cutter accessory 22.

Periodic Maintenance. While the access door 30 is typically opened only to resolve an error condition, it may be opened at any time, at which point the controller 34 of the cutter accessory 22 will be placed into its inactive state, as described above. If the controller 34 does not register an error condition, then it may automatically transition from its inactive state to its active state upon the access door 30 being closed, although it is also within the scope of the present disclosure for the controller 34 to be programmed to execute a preliminary error check upon the access door 30 moving to its closed position to ensure that the printing device 10 is also ready for normal operation.

One of the reasons for opening the access door 30 in the absence of an error condition is to perform regular, periodic maintenance on the cams 44 and/or the cutting blade 44. It may be advantageous to perform regular, periodic maintenance on the components of the cutter accessory 22 to better ensure consistent performance of the printing system 24 as intended. Maintenance of the printing system 24 by necessity requires down time until the maintenance is complete, but the configuration of the cutter accessory 22 is such that minimal down time is required to perform routine maintenance.

Figure 9:
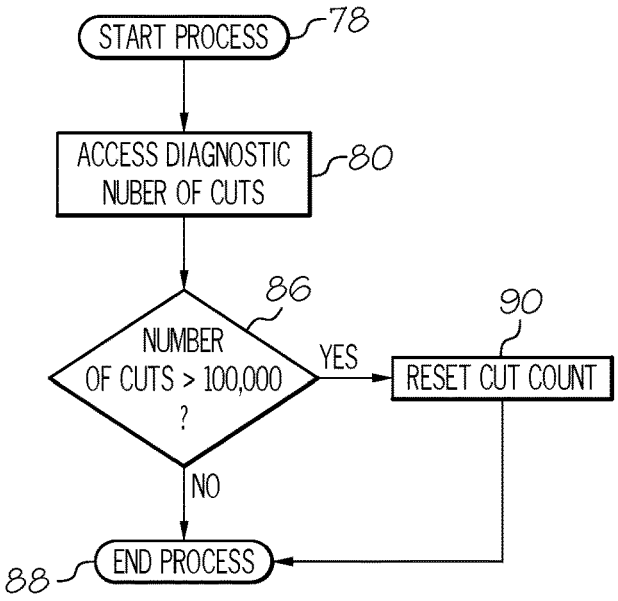
FIG. 9 is a diagrammatic view of a protocol executed by the controller of the cutter accessory to determine whether periodic maintenance is required.

FIG. 9 is an exemplary protocol that may be carried out by the controller 34 of the cutter accessory 22 to determine whether maintenance is recommended. The process begins when a user or service technician requests information regarding the number of times that the cutting blade 42 has been moved at the command of the controller 34 (represented in FIG. 9 at 78). The controller 34 may be programmed to count and keep track of the number of times that the cutting blade 42 has been moved at the command of the controller 34, so it may access this count at stage 80.

Figure 10:
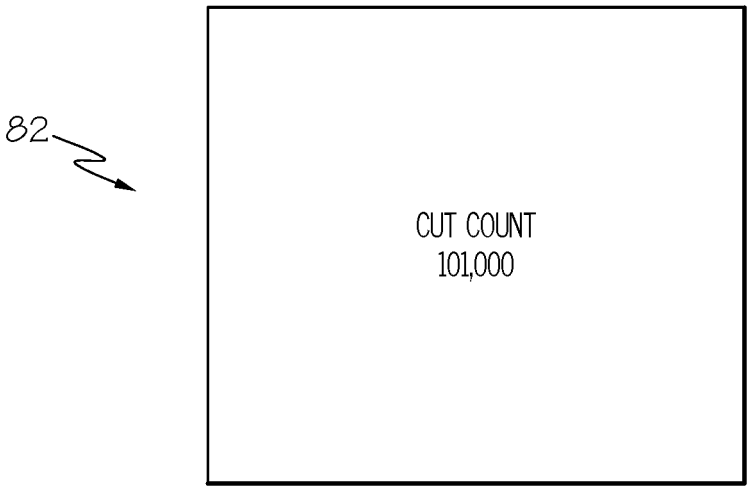
FIG. 10 illustrates an exemplary image that may be displayed on a display screen of the printing device of FIG. 1 to indicate the number of times that the cutter accessory has cut printed material issued by the printing device.
Figure 11:
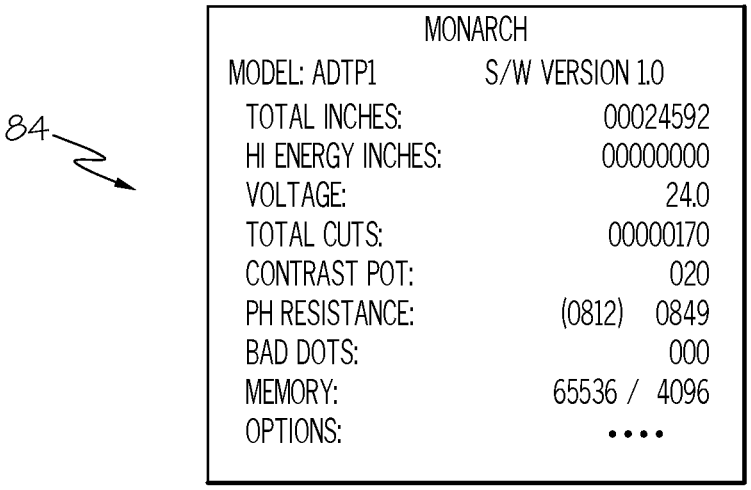
FIG. 11 illustrates an exemplary unit or piece of printed material that may be issued by the printing device to indicate the number of times that the cutter accessory has cut printed material issued by the printing device.

The controller 34 may inform the user or service technician of the count by transmitting a signal to the printing device 10 to display at least one image 82 that is indicative of the count on the display screen 16, as shown in FIG. 10. The count on the display stream could appear as an informative message to the user during normal operation of the device. When the number of cuts reaches the service level a message can briefly appear to the user to inform them of the need to provide maintenance. This count can be reset after the cutter door is opened providing access for service. Alternatively, or additionally, the controller 34 may instruct the printing device 10 to generate a unit or piece of printed material 84 (FIG. 11) with at least one image that is indicative of the count and may also include additional diagnostic information.

Upon reporting the count to the user or service technician, the controller 34 may compare the count to a preselected number (represented in FIG. 9 at 86). The preselected number may correspond to the recommended number of times that the cutting blade 42 is moved under command of the controller 34 before periodic maintenance is performed. In the illustrated embodiment, the preselected number is 100,000, but any other preselected number may be used without departing from the scope of the present disclosure.

If the count is less than preselected number (represented in FIG. 9 by a "NO" decision), then the process is exited (represented in FIG. 9 at 88). On the other hand, if the count is greater than the preselected number (represented in FIG. 9 by a "YES" decision), then the controller 34 may reset the count and recommend that maintenance be performed on the cutter accessory 22 (represented in FIG. 9 at 90). The user or service technician may service the cutter accessory 22 by opening the access door 30 to expose the cams 44. The user or service technician then uses a cotton swab to add grease to the cams 44. The cams 44 can be rotated manually to expose all the surface area to facilitate the maintenance process. The access door 30 is then closed, which causes the process of FIG. 9 to be exited.

In another embodiment, rather than relying upon a cut count to be requested by a user or service technician, the controller 34 may be programmed to recognize when the cut count equals or exceeds the preselected number. When the controller 34 determines that the cut count meets or exceeds the preselected number, it may alert a user or service technician by instructing the printing device 10 to generate a piece or unit of printed material with this recommendation and/or to display the recommendation on the display screen 16 or may otherwise alert a user or service technician that periodic maintenance is recommended.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A cutter accessory for use in combination with a printing device, comprising: a body configured to be mounted onto a printing device;

an access door mounted to the body and movable between a closed position and an open position;

a slot defined in the access door and configured to receive printed material from the printing device when the access door is in the closed position;

a cutting blade movably mounted to the body; and at least one cam associated with the cutting blade and operable to move the cutting blade with respect to the slot to cut the printed material from the printing device, wherein the at least one cam is accessible when the access door is in the open position and inaccessible when the access door is in the closed position.

2. The cutter accessory of claim 1, wherein the access door is hingedly connected to the body.

3. The cutter accessory of claim 1, wherein the body is configured to be removably mounted onto the printing device.

4. The cutter accessory of claim 1, further comprising a controller programmed with an active state and an inactive state, wherein the controller controls the at least one cam to move the cutting blade in the active state and not in the inactive state, and the controller transitions from the active state to the inactive state upon detecting an error condition.

5. The cutter accessory of claim 4, wherein the controller is programmed to transmit an error signal to the printing device upon transitioning from the active state to the inactive state to display at least one image indicative of the error condition.

6. The cutter accessory of claim 4, wherein the controller is programmed to transmit a ready signal to the printing device upon resolution of the error condition to display at least one image indicative of the error condition being resolved.

7. The cutter accessory of claim 1, further comprising a controller programmed with an active state and an inactive state, wherein the controller controls the at least one cam to move the cutting blade in the active state and not in the inactive state, and the controller transitions from the active state to the inactive state when the access door is moved from the closed position to the open position.

8. The cutter accessory of claim 7, wherein the controller is programmed to transmit an open door signal to the printing device upon transitioning from the active state to the inactive state to display at least one image indicative of the access door being in the open position.

9. The cutter accessory of claim 1, further comprising a controller programmed with an active state and an inactive state, wherein the controller controls the at least one cam to move the cutting blade in the active state and not in the inactive state, and the controller transitions from the active state to the inactive state when the access door is moved from the closed position to the open position and/or upon detecting an error condition.

10. The cutter accessory of claim 9, wherein the controller is programmed to transition from the inactive state to the active state when the error condition has been resolved and the access door is in the closed position.

11. The cutter accessory of claim 1, further comprising a controller, wherein the controller is programmed to count the number of times that the at least one cam has been operated to move the cutting blade.

12. The cutter accessory of claim 11, wherein the controller is programmed to transmit a count signal to the printing device to instruct the printing device to display at least one image indicative of the number of times that the at least one cam has been operated to move the cutting blade.

13. The cutter accessory of claim 11, wherein the controller is programmed to transmit a count signal to the printing device to instruct the printing device to generate printed material indicative of the number of times that the at least one cam has been operated to move the cutting blade.

14. A printing system, comprising:

a printing device comprising a housing and an opening defined in the housing and configured to issue printed material; and a cutter accessory comprising a body mounted to the housing of the printing device, an access door mounted to the body and movable between a closed position and an open position, a slot defined in the access door and at least partially aligned with the opening of the printing device to receive printed material issuing from the opening of the printing device when the access door is in the closed position, a cutting blade movably mounted to the body, and at least one cam associated with the cutting blade and operable to move the cutting blade with respect to the slot to cut the printed material issuing from the printing device, wherein the at least one cam is accessible when the access door is in the open position and inaccessible when the access door is in the closed position.

15. The printing system of claim 14, wherein the access door is hingedly connected to the body.

16. The printing system of claim 14, wherein the cutter accessory is removably mounted to the printing device.

17. The printing system of claim 14, wherein the cutter accessory further includes a controller programmed with an active state and an inactive state, wherein the controller controls the at least one cam to move the cutting blade in the active state and not in the inactive state, and the controller transitions from the active state to the inactive state upon detecting an error condition.

18. The printing system of claim 17, wherein the printing device includes a display screen, and the controller is programmed to transmit an error signal to the printing device upon transitioning from the active state to the inactive state to cause the display screen to display at least one image indicative of the error condition.

19. The printing system of claim 17, wherein the controller is programmed to transmit a ready signal to the printing device upon resolution of the error condition to cause the display screen to display at least one image indicative of the error condition being resolved.

20. The printing system of claim 14, wherein the cutter accessory further includes a controller programmed with an active state and an inactive state, wherein the controller controls the at least one cam to move the cutting blade in the active state and not in the inactive state, and the controller transitions from the active state to the inactive state when the access door is moved from the closed position to the open position.

21. The printing system of claim 20, wherein the printing device includes a display screen, and the controller is programmed to transmit an open door signal to the printing device upon transitioning from the active state to the inactive state to cause the display screen to display at least one image indicative of the access door being in the open position.

22. The printing system of claim 14, wherein the cutter accessory further includes a controller programmed with an active state and an inactive state, wherein the controller controls the at least one cam to move the cutting blade in the active state and not in the inactive state, and the controller transitions from the active state to the inactive state when the access door is moved from the closed position to the open position and/or upon detecting an error condition.

23. The printing system of claim 22, wherein the controller is programmed to transition from the inactive state to the active state when the error condition has been resolved and the access door is in the closed position.

24. The printing system of claim 14, wherein the cutter accessory further includes a controller programmed to count the number of times that the at least one cam has been operated to move the cutting blade.

25. The printing system of claim 24, wherein the printing device includes a display screen, and the controller is programmed to transmit a count signal to the printing device to cause the display screen to display at least one image indicative of the number of times that the at least one cam has been operated to move the cutting blade.

26. The printing system of claim 24, wherein the controller is programmed to transmit a count signal to the printing device to cause the printing device to issue printed material indicative of the number of times that the at least one cam has been operated to move the cutting blade.

* * * * *